US007221552B1

(12) United States Patent
Brown

(10) Patent No.: US 7,221,552 B1
(45) Date of Patent: May 22, 2007

(54) WEARABLE SHIELD AND SELF-DEFENSE DEVICE

(76) Inventor: David C. Brown, 42 Glenalmond La., Ladera Ranch, CA (US) 92694

( * ) Notice: Subject to any disclaimer, the term of this patent is extended or adjusted under 35 U.S.C. 154(b) by 0 days.

(21) Appl. No.: 11/388,839

(22) Filed: Mar. 23, 2006

(51) Int. Cl.
*H01G 23/00* (2006.01)

(52) U.S. Cl. ..... 361/232

(58) Field of Classification Search ..... 361/232
See application file for complete search history.

(56) References Cited

U.S. PATENT DOCUMENTS

| | | | | |
|---|---|---|---|---|
| 3,998,459 | A | 12/1976 | Henderson et al. | |
| 4,370,696 | A | 1/1983 | Darrell | |
| 4,485,426 | A | 11/1984 | Kerls | |
| 4,557,275 | A | 12/1985 | Dempsey, Jr. | |
| 4,945,811 | A | 8/1990 | Grieb | |
| 5,103,366 | A * | 4/1992 | Battochi | 361/232 |
| 5,193,048 | A * | 3/1993 | Kaufman et al. | 361/232 |
| 5,282,481 | A | 2/1994 | Ziemer | |
| 5,546,844 | A | 8/1996 | Krumm et al. | |
| 5,588,398 | A * | 12/1996 | Allen et al. | 119/822 |
| 5,658,316 | A | 8/1997 | Lamond et al. | |
| 5,698,815 | A | 12/1997 | Ragner | |
| 5,801,866 | A | 9/1998 | Chan et al. | |
| 5,884,198 | A * | 3/1999 | Kese et al. | 455/575.6 |
| 6,211,672 | B1 | 4/2001 | Bauman et al. | |
| 6,456,884 | B1 | 9/2002 | Kenney | |
| 6,646,855 | B2 | 11/2003 | Buening et al. | |
| 6,870,089 | B1 | 3/2005 | Gray | |
| 6,876,302 | B1 | 4/2005 | Steeves | |
| 6,961,227 | B1 * | 11/2005 | Whiton et al. | 361/232 |
| 7,012,797 | B1 * | 3/2006 | Delida | 361/230 |
| 2002/0178485 | A1 | 12/2002 | Medves | |
| 2003/0137795 | A1 | 7/2003 | Buening et al. | |
| 2004/0154071 | A1 | 8/2004 | Frahm | |
| 2004/0264099 | A1 | 12/2004 | Sikes et al. | |

* cited by examiner

*Primary Examiner*—Stephen W. Jackson
(74) *Attorney, Agent, or Firm*—Michael Shippeyu; Law Offices of Karla Shippey

(57) ABSTRACT

A personal defense device is provided that includes a shield and an electric shock device. The shield is configured to protect a user and circuitry from physical attack. The personal defense device is configured to be worn by a user such that it is difficult or impossible for an attacker to remove the personal defense device during an attack. In one embodiment, the personal defense device includes a gauntlet-style glove attached to the shield and electric shock device so as to provide protection for a user's forearm. The electric shock device is configured to deliver less-lethal electrical shocks and/or sparks to startle, disarm, and repel an aggressor.

32 Claims, 13 Drawing Sheets

Fig. 12
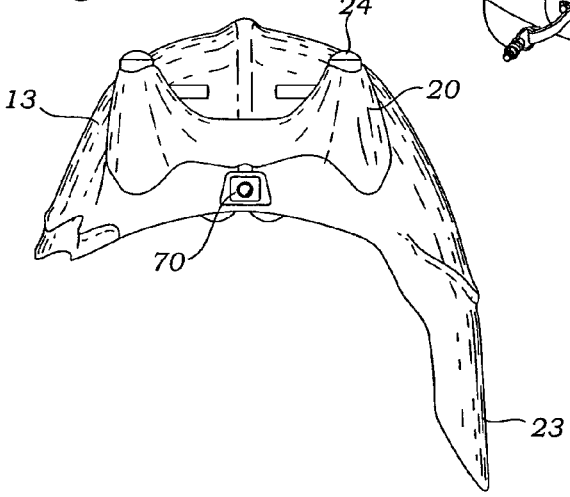
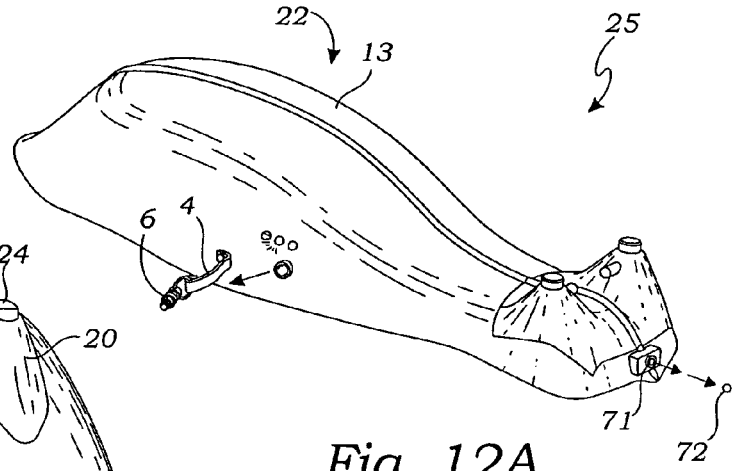
Fig. 12A
Fig. 12B
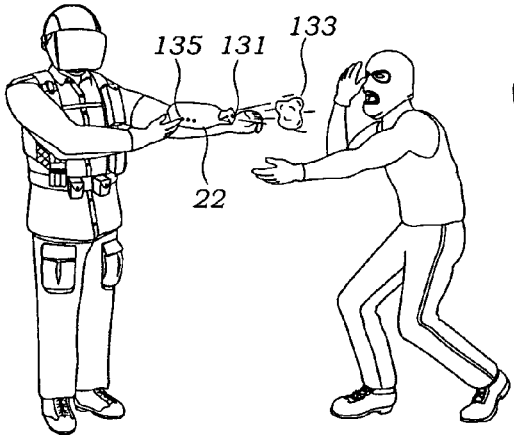
Fig. 12C
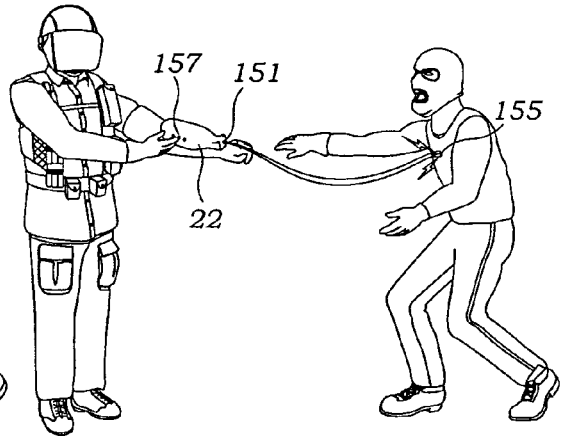

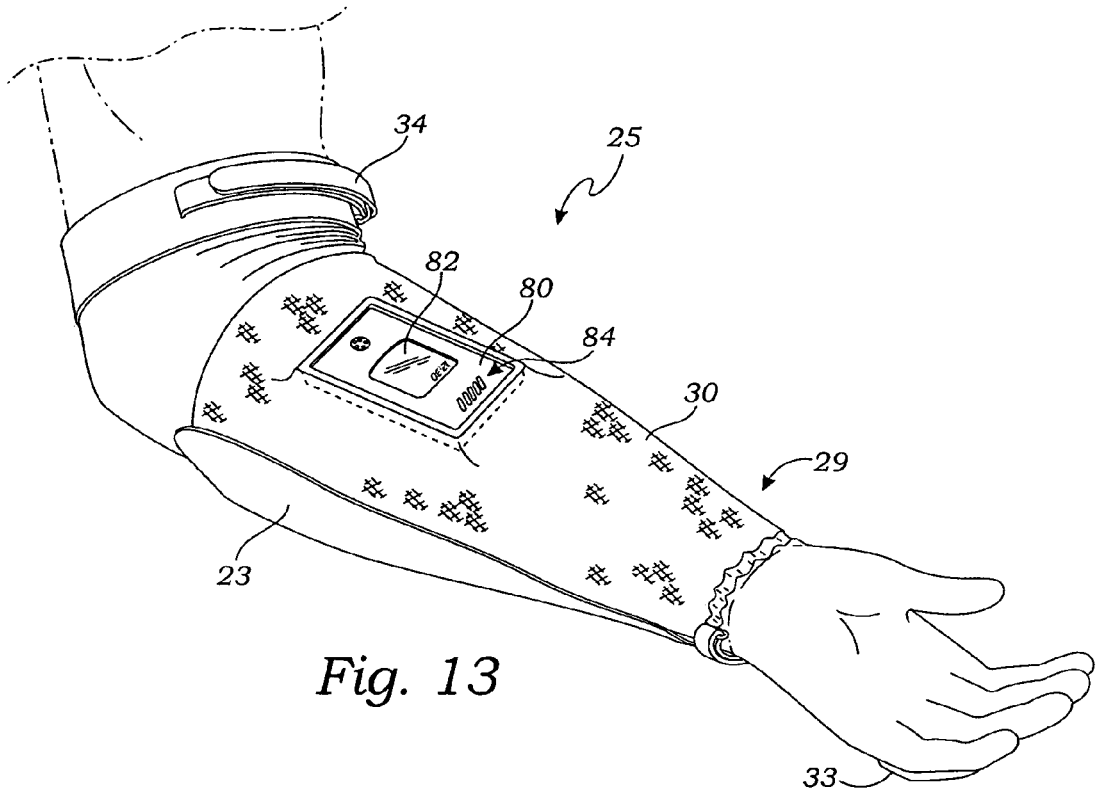
Fig. 13
Fig. 13A
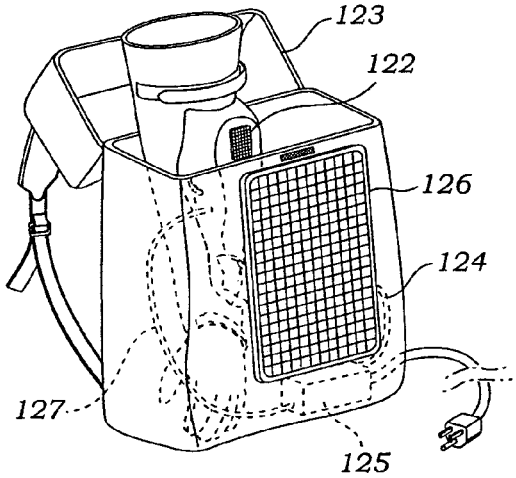
Fig. 13B
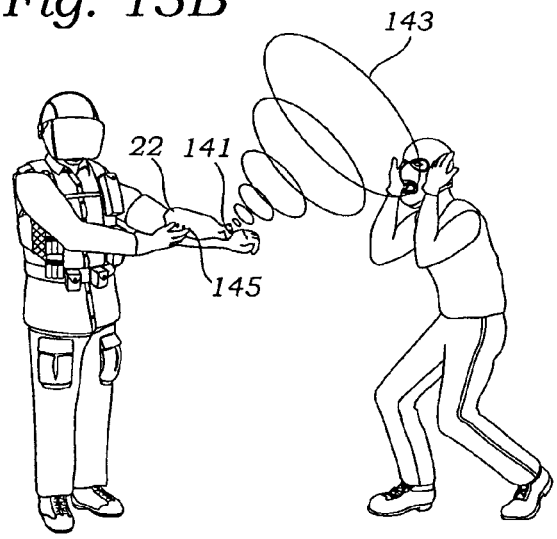

WEARABLE SHIELD AND SELF-DEFENSE DEVICE

BACKGROUND OF THE INVENTION

1. Field of the Invention

The present invention relates to a wearable shield and electrical shock device for self-defense.

2. Description of the Related Art

Police, military, and other individuals use a wide variety of protective gear and lethal or less-lethal weapons to defend themselves from attacks. Police riot gear may include, for example, firearms, helmets, batons, hand-held shields, impact resistant or bullet proof vests, protective eye goggles, gas masks, and other devices configured to subdue an attacker or shield against a physical assault.

One type of less-lethal or non-lethal weapon is a hand-held electrical shock device or hand-held electrical stun weapon that delivers a high-voltage electrical shock through direct contact with electrodes that are either attached to a hand-held device or are projected by a hand-held gun with wires connected to the electrodes. Generally, the person or animal receiving an electrical shock from such a device is incapacitated for a period of time. However, like other hand-held weapons (both lethal and less-lethal), an attacker can easily separate a user from a conventional hand-held electrical shock device. For example, an attacker may grab or knock the hand-held electrical shock device away from the user, which might render the user defenseless. Further, the attacker may gain control of the hand-held electrical shock device and use it to incapacitate the original user.

Hand-held electrical shock devices are also difficult or inconvenient to use in conjunction with another weapon or when a user needs both hands free for other tasks. For example, a soldier or police officer will generally stow their hand-held electrical shock device in a holster or holder when not in use to allow them to perform such tasks as handle a fire arm, hold a hand-held shield, or frisk a suspect. With the hand-held electrical shock device stowed, the user may not be able to retrieve it in time to defend against an attack.

Other electrical shock devices include a glove having electrodes positioned on the glove such that a user wearing the glove can shock an attacker by touching them with the electrodes. Such devices typically include an activation switch or contact on the glove to activate the electrodes. However, positioning the electrodes on the glove increases the risk that a person, animal or object being handled by the user will be inadvertently shocked. Further, placing the activation switch on the glove in close proximity to the electrodes increases this risk. In addition, conventional electrical shock gloves can generally be easily disabled or removed from a user by an attacker and do not provide impact or tamper resistant protection to the electrical circuitry of the device. Conventional electrical shock gloves also do not provide impact shielding to the user.

SUMMARY OF THE INVENTION

Thus, it would be advantageous to develop a wearable shield to protect a user from impact during a physical confrontation with an attacker. It would also be advantageous for the wearable shield to include an electrical shock device for personal protection that is resistant to being disabled or removed from the user by an attacker and is ready to be used even while the user's hands are occupied with other tasks. Further, it would be advantageous for the electrical shock device to provide an audible and/or visible warning to a potential attacker.

In one embodiment, a personal defense device includes a member configured to extend over at least a third of a length of a user's forearm. The forearm being bounded by the user's ipsilateral wrist and the user's ipsilateral elbow. The length measured from the ipsilateral wrist to the ipsilateral elbow. A plurality of electrical terminals extend from the member. A first pair of the plurality of electrical terminals is configured to deliver an electrical shock to a human or other animal. In certain such embodiments, the member is configured to house electrical circuitry located within the member. The electrical circuitry can be configured, for example, to convert a first voltage level to a second voltage level and to provide the second voltage level to at least the first pair of terminals. The second voltage level is higher than the second voltage level and is configured to disable, at least temporarily, the human or other animal.

In some embodiments, the member is configured to shield the forearm from an attacker and includes at least one of carbon fiber, Kevlar®, Dyneema, ballistic nylon, foam and gel. The member is configured to absorb and disperse an impact from an attacker. In certain embodiments, the member is configured to be bullet proof and cut resistant. Some embodiments also include a pair of terminals configured to generate a spark that generates an electrical arcing noise in an audible range between about 65 decibels and about 75 decibels at a distance of about 1 meter.

In some embodiments, the personal defense device further includes a glove having a gauntlet portion comprising the member. The gauntlet portion is configured to extend above the user's elbow. The glove comprises one or more attachment devices configured to resist removal of the glove from the user by an attacker. Some embodiments also include a trigger attached to the glove, the trigger being user selectable to deliver a voltage to the plurality of electrical terminals. The trigger is attached below an outer surface of the palm of the glove. The personal defense device can also include an activation port configured to prevent the selective delivery of the electrical shock when a disarm pin is inserted therein, and to allow the selective delivery of the electrical shock when the disarm pin is removed from the activation port. The personal defense device may also include indicia of available power for the electrical shock.

In some embodiments, the electrodes are located on a saddle-shaped head attached to the member. In some embodiments, the personal defense device also includes an imaging device and the personal defense device is configured to transmit image data from the imaging device to a receiving station that receives and displays the image data. In some embodiments, the personal defense device also includes a global positioning device configured to transmit position data to a receiving station configured to receive and display the position data.

In some embodiments, the personal defense device includes a light source connected to the member. In some embodiments, the personal defense device includes an enclosure for housing one or more batteries and at least one solar panel connected to the enclosure, wherein the solar panels are configured to charge the batteries, and wherein the batteries are connectable to the member and configured to charge the member. In some embodiments, the personal defense device includes a siren connected to the member. In some embodiments, the personal defense device includes a solution, wherein the solution is configured to be projected from the member. The solution can be any solution used to defend or attack another person or animal, including, for example, pepper spray or tear gas. In some embodiments, the personal defense device includes a second member connectable to the electrical terminals for defibrillating a person in need of defibrillation.

In another embodiment, a method of defending oneself from an attacker includes wearing a member over a forearm and shocking the attacker with the member. In some embodiments, the member comprises a shield. The method may also include generating an electrical arcing noise from the member. The electrical arcing noise is configured to frighten the attacker. The method may also include transmitting data from the member to a receiving station. The data may include, for example, image data, audio data, and/or location data. In some embodiments, the method also includes deflecting a blow from the attacker with the member.

In another embodiment, a personal defense device includes means for shielding a user's forearm from a physical attack and means for delivering an electrical shock from the means for shielding the user's forearm. In some embodiments, the means for shielding the user's arm is further configured to shield the means for delivering the electrical shock. In one embodiment, the personal defense device includes means for projecting a projectile. In one embodiment, the personal defense device includes means for defibrillating a person in need of defibrillation. In one embodiment, the personal defense device includes means for producing light. In one embodiment, the personal defense device includes means for charging, such as, for example, by a solar panel. In one embodiment, a solar panel is located on the personal defense device. In one embodiment, a solar panel is placed on a storage enclosure. In one embodiment, the personal defense device includes means for producing noise. In one embodiment, the personal defense device includes means for spraying a solution.

Other features and advantages of the present invention will become apparent to those of ordinary skill in the art through consideration of the ensuing descriptions, the accompanying drawings, and the appended claims. Neither this summary, nor the following detailed description defines the scope of the invention.

BRIEF DESCRIPTION OF THE DRAWINGS

Systems and methods which embody the various features of the disclosure will now be described with reference to the following drawings:

FIG. 12 is a front view of a housing shield including a camera according to another embodiment of the invention;

FIG. 12A is a perspective view a shield assembly including a projectile system;

FIG. 12B illustrates a use of the personal defense device by a police officer in subduing an attacker by spraying a solution on the attacker;

FIG. 12C illustrates a use of the personal defense device by a police officer in subduing an attacker by projecting electrodes at an attacker;

FIG. 13 is a perspective view of the underside of the arm gauntlet of the personal defense device of FIG. 4 including a global positioning unit according to an embodiment of the invention;

FIG. 13A illustrates an enclosure for storing the personal defense device;

FIG. 13B illustrates a use of the personal defense device by a police officer in subduing an attacker by using a loud noise to stop an attacker;

DETAILED DESCRIPTION OF THE PREFERRED EMBODIMENT

Figure 1:
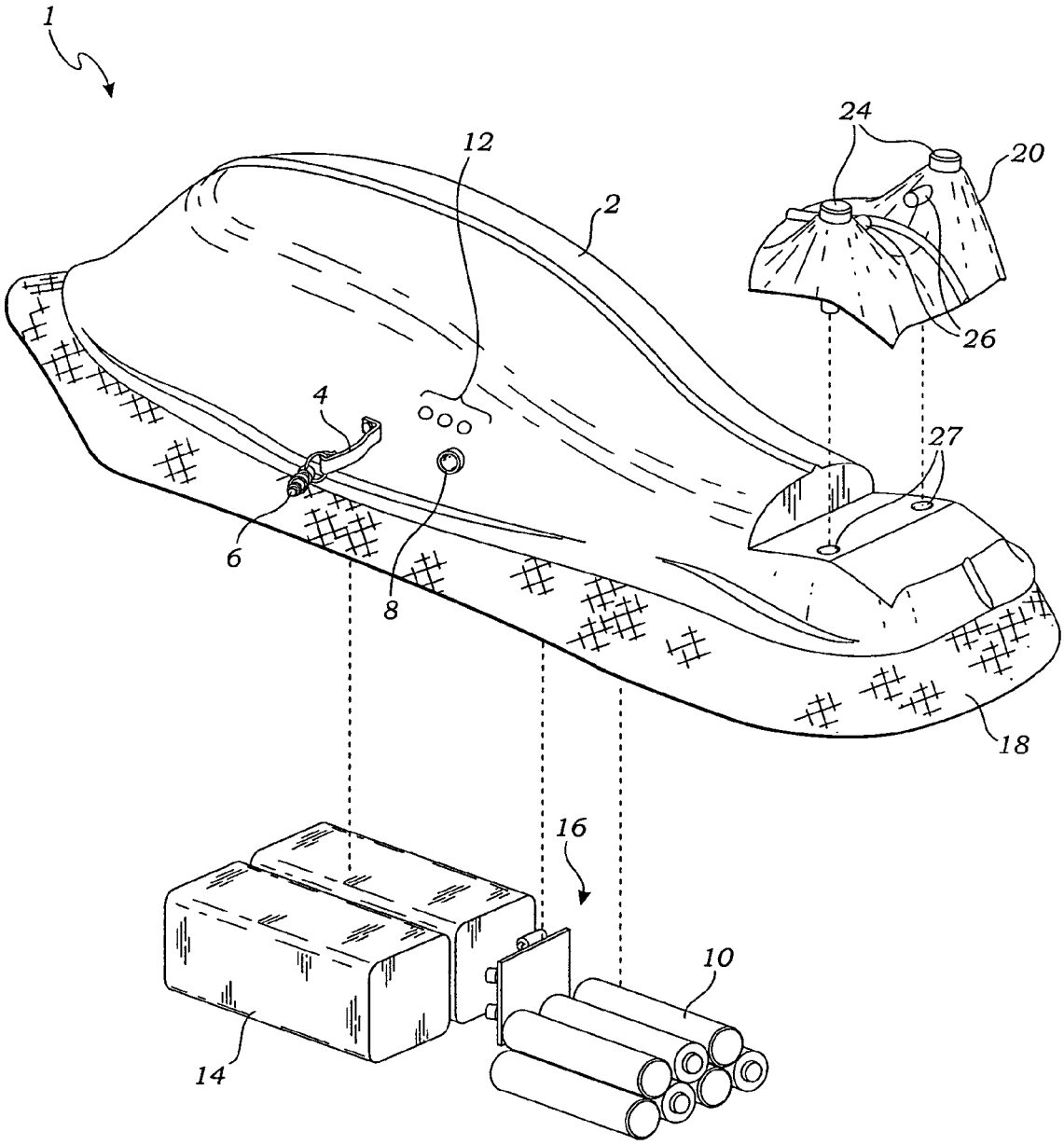
FIG. 1 is a perspective view of portions of an exemplary shield assembly configured to provide a shield and an electrical shock according to an embodiment of the invention.

The present disclosure relates to a wearable shield and electrical shock device for self defense. Embodiments of a personal defense device disclosed herein include an arm shield with an electrical shock device positioned thereon. The electrical shock device according to some embodiments includes a sparking device and a device for the delivery of a less-lethal electric shock to an aggressor. The aggressor may be, for example, a human or animal. As used herein, the term "less-lethal" is a broad term having its ordinary and customary meaning and includes, for example, non-lethal force and force that is less likely to be lethal when compared to a gunshot wound, a stab wound, a blow from a blunt object, or the like. A less-lethal shock may be used for defensive purposes to disable an attacker without permanently injuring or killing the attacker. It is recognized, however, that some embodiments may be configured to have lethal consequences, at least for some targets.

The personal defense device can be worn while carrying or operating other weapons and offers an effective, less-lethal defensive aid for a user. The sparking device is visible and emits an electric arcing sound when activated to frighten a would-be attacker. The audible shocking sound, which can be emitted on demand, is unnerving and deters attackers. If the warning sound fails to deter the attack, a physical shock can be applied to the attacker, disabling the attacker and rendering the attacker unable to focus and carry out the attack. The attacker will either be rendered immobile, or will have ample reason and impulse to flee.

The wearable shield provides a defensive device that protects against blows from an attacker. The shield is impact-resistive and impact-dispersive so as to protect a user of the personal defense device as well as electric shock circuitry positioned beneath the shield. In certain embodiments, the electronics and the user's arm are further protected from blows by a solid foam or gel that surrounds the electronics within the shield. Thus, the shield works directly as a passive defense shield, when called upon for that purpose by the user. The shield is hard and strong and can also be used to hit an attacker. The shield is also lightweight and portable and can be worn comfortably for extended periods of time.

In certain embodiments, the shield includes straps for attaching the shield to a user's forearm or other body part. In other embodiments, the shield is attached to the gauntlet of a gauntlet glove such that it cannot be easily removed from a user wearing the glove by an attacker. In certain embodiments, the wearable shield is worn so as to be visually noticeable. In other certain embodiments, the wearable shield is concealed, such as, for example, under clothing or by altering its appearance to look like a natural part of an arm and/or hand, so that it is not readily noticeable. In some embodiments, the wearable shield is configured to be small enough to fit under the sleeve of a shirt in order to be concealed for use by, such as, for example, an air marshal or an undercover police officer. In some embodiments, nanotechnology is used to make the wearable shield small enough to fit under the sleeve of a shirt.

In the following description, reference is made to the accompanying drawings, which form a part hereof, and which show, by way of illustration, specific embodiments or processes in which the invention may be practiced. Where possible, the same reference numbers are used throughout the drawings to refer to the same or like components. In some instances, numerous specific details are set forth in order to provide a thorough understanding of the present disclosure. The present disclosure, however, may be practiced without the specific details or with certain alternative equivalent components and methods to those described herein. In other instances, well-known components and methods have not been described in detail so as not to unnecessarily obscure aspects of the present disclosure.

FIG. 1 is a perspective view of portions of an exemplary shield assembly 1 configured to provide a shield and an electrical shock according to an embodiment of the invention. The shield assembly 1 is configured to be worn over the forearm of a user and protects the user's forearm while allowing the user to electrically shock an animal or another person that comes in contact with the shield assembly 1. For illustrative purposes, the shield assembly 1 is shown partially disassembled. The shield assembly 1 includes a housing shield 2, a battery pack 10, a high voltage module 14, a battery state indicator module 16, and an arc head 20.

The housing shield 2 comprises a hard material configured to resist and disperse an impact force from, for example, an attacker. Suitable materials for the housing shield 2 include, for example, hard plastic polymers, metals, and metal alloys. In an exemplary embodiment, the housing shield 2 comprises a strong and lightweight material such as a carbon fiber composite. In addition, or in other embodiments, the housing shield 2 includes strong, light weight, flexible materials such as Kevlar® available from DuPont Advanced Fibers Systems of Richmond, Va., Dyneema, available from DSM Dyneema of Geleen, the Netherlands, and/or ballistic nylon to further resist and disperse impact forces. As discussed in detail below, the housing shield 2 may also include a non-conductive foam and/or gel to absorb and disperse impact forces.

When assembled and in use, the battery pack 10, high voltage module 14, and battery state indicator module 16 are housed within the housing shield 2. The housing shield 2 is configured to protect the battery pack 10, the high voltage module 14, and the battery state indicator module 16 from impact forces and from tampering when worn on a user's forearm. Thus, it is difficult or impossible for an attacker, for example, to destroy or disable the shield assembly 1.

The arc head 20 includes a vertical set of electrically conductive terminals 24 configured to deliver a high voltage electrical shock to a person, animal or object that comes into contact with the vertical set of terminals 24. As shown in FIG. 1, in an embodiment, the arc head 20 is saddle shaped with the vertical set of terminals 24 located at opposite peaks of the saddle. The saddle shaped arc head 20 allows the vertical set of terminals to extend away from the housing shield 2 to facilitate contact with an attacker. In an embodiment, the vertical set of terminals 24 are separated from each other by a distance in a range between approximately 1.4 inches and approximately 1.6 inches. In certain such embodiments, the vertical set of terminals 24 are sufficiently spaced from one another so that they do not produce an electrical arc when provided with power from the high voltage module 14. In certain embodiments, the arc head comprises a small area so as to reduce the risk of accidental electrocution. In certain embodiments, the arc head 20 is made from a strong and durable material and construction such that it can withstand would be attacker's blows, as well as being strong enough for uses such as, for example, breaking a car window. The arc head 20 can be made from the same materials as housing shield 2 described above. Thus, the shield assembly 1, including arc head 20, can be used as a shield, a baton, an electrical stun device, as well as other useful tool.

In certain embodiments, the arc head 20 also includes a horizontal set of electrically conductive terminals 26 configured to produce an electrical arc when provided with power from the high voltage module 14. As shown in FIG. 1, in certain such embodiments, the horizontal set of terminals 26 extend horizontally from the peaks of the saddle shaped arc head 20 below the vertical set of terminals 24. In certain such embodiments, the horizontal set of terminals 26 are electrically connected to the respective vertical terminals 24 located in the same peak of the saddle shaped arc head 20. For example, the left horizontal terminal 26 is electrically connected to the left vertical terminal 24, and the right horizontal terminal 26 is electrically connected to the right vertical terminal 24.

The horizontal set of terminals 26 are spaced closer together than the vertical set of terminals 24 so as to generate an electrical arc that can be seen and/or heard by people or animals in the vicinity of a user of the shield assembly 1. In an embodiment, the horizontal set of terminals 26 are separated from each other by a distance in a range between approximately 0.3 inches and approximately 0.5 inches. The sight and/or arcing sound of the electrical arc generated between the horizontal terminals 26 is configured to frighten a would-be attacker. Thus, the would-be attacker may be scared away or scared into submission without electrically shocking the would-be attacker. In one embodiment, the loudness of the arcing sound is in a range between approximately 65 decibels and approximately 75 decibels at a distance of approximately 1 meter. However, an artisan will recognize from the disclosure herein that the loudness of the arcing sound may be in other ranges and that the recognizable sight and/or sound of the electrical arc is generally sufficient to frighten a would-be attacker regardless of how loud it is.

The arc head 20 mounts as shown in FIG. 1 to mounting posts 27 on top of the housing shield 2. In another embodiment, the arc head 20 is mounted through an opening (not shown) in the housing shield 2 from below and is snapped into place such that the arc head 20 cannot be pulled from the housing shield 2 by an attacker. The arc head 20 is configured to electrically insulate the terminals 24, 26 from the housing shield 2. Thus, the arc head protects electrical circuitry within the housing shield 2 and the user from an electrical shock produced by the terminals 24, 26. Suitable materials for the arc head 20 include, for example, highly durable plastic polymers or other hard, non-conductive materials.

The housing shield 2 includes a disarm pin 6 attached to the housing shield 2 by a retainer strap 4. The housing shield 2 also includes an activation port 8, and one or more light emitting diodes (LEDs) 12 configured to indicate the status of the battery pack 10. In one embodiment, the LEDs 12 are mounted on one side of the housing shield 2 near the disarm pin 6 and activation port 8. As shown in FIG. 1, in one embodiment, there are at least three LEDs 12, at least one of which is lit when the shield assembly 1 is active (as discussed below) such that a shock can be delivered.

In an exemplary embodiment, the three LEDs 12 are red, yellow and green. The green light is lit when the battery pack 10 is amply charged. The yellow light is lit when the battery pack 10 needs charging. The red light is lit when the battery pack 10 is critically discharged. If none of the LEDs 12 are lit when the shield assembly 1 is activated (as discussed below) the battery pack 10 is discharged such that it can provide little or no power and should be recharged. Alternatively, if replaceable, the discharged battery pack 10 can be replaced with a freshly charged pack. An artisan will recognize from the disclosure herein that more or less LEDs can be used, or that a digital or analog power meter could be used instead of the LEDs 12. Further, an artisan will recognize that any color or color combination can be used for the LEDs 12.

The battery pack 10 includes one or more batteries (seven shown) and provides power to electrical circuitry of the shield assembly 1, including the high voltage module 14, the arc head 20, the LEDs 12, and the battery state indicator module 16. In one embodiment, the battery pack 10 includes one or more rechargeable batteries that can be recharged by connecting an external power charger (not shown) to the activation port 8 to initiate a recharge sequence for the battery pack 10. The battery state indicator module 16 is configured to measure the relative charge remaining in the battery pack 10 and drive the LEDs 12 as discussed above. The high voltage module 14 is configured to convert a relatively low voltage from the battery pack 10 to a relatively high voltage provided to the terminals 24, 26 of the arc head 20. For example, in one embodiment, the high voltage module 14 converts a first voltage in a range between approximately 9 V and approximately 27 V to a second voltage in a range between approximately 20,000 V and 150,000 V. In other embodiments, the second voltage is in a range between approximately 300,000 V and approximately 1,000,000 V. In other embodiments, the second voltage is in a range between approximately 650,000 V and approximately 850,000 V. In other embodiments, the second voltage is in a range between approximately 150,000 V and approximately 300,000 V. In still other embodiments, the second voltage is in a range between approximately 1 V and 20,000 V. Of course, a person of ordinary skill in the art will recognize that any non-lethal or lethal voltage range may be used with the devices of the present disclosure. The specified ranges are given by way of example and not limitation.

The disarm pin 6 is configured to be removably inserted into the activation port 8. The shield assembly 1 is activated or armed when the disarm pin 6 is removed from the activation port 8. With the disarm pin 6 removed, the high voltage module 14 can provide power to the terminals 24, 26 on the arc head 20. In one embodiment, power is provided to the terminals 24, 26 when the disarm pin 6 is removed from the activation port 8 and a user controlled trigger (not shown) is also activated. Thus, a user can activate the shield assembly 1 when desired by pulling the disarm pin 6 from the activation port 8 and then fire the weapon when desired using the trigger to deliver an electrical shock through the terminals 24, 26. The trigger can be located, for example, on or near the shield assembly 1. In some embodiments, the trigger is located on a glove attached to the shield assembly 1. As discussed in more detail below, in some embodiments, the trigger is located in the palm of a glove attached to the shield assembly 1.

The shield assembly 1 is deactivated or disarmed when the disarm pin 6 is inserted into the activation port 8. Thus, an attacker could not disarm the shield assembly 1 by yanking on the retainer strap 4 or otherwise attempting to pull the disarm pin 6 from the activation port 8 (which would activate the shield assembly 1). When disarmed, power is not provided from the high voltage module 14 to the terminals 24, 26 on the arc head 20. In one embodiment, a friction pressure fit between the disarm pin 6 and the activation port 8 prevents or reduces inadvertent removal of the disarm pin 6 from the activation port 8.

FIG. 1 also illustrates an apron 18 attached around the lower edge of the housing shield 2. As discussed below, the apron 18 is used in accordance with one embodiment to mount the housing shield 2 to an arm gauntlet of a gauntlet style glove. In certain such embodiments, the housing shield 2 comprises a carbon fiber composite material and the apron 18 comprises a strong and flexible material that is bound between carbon fiber layers from which it extends. The apron 18 can be inserted between fabric layers of the glove's arm gauntlet and attached thereto, such as, for example, by sewing, glue, or any other suitable attachment methods. Suitable materials for the apron include, for example, Kevlar®, Dyneema, or other sewable materials that are light weight, high impact resistant, and highly durable.

Figure 2:
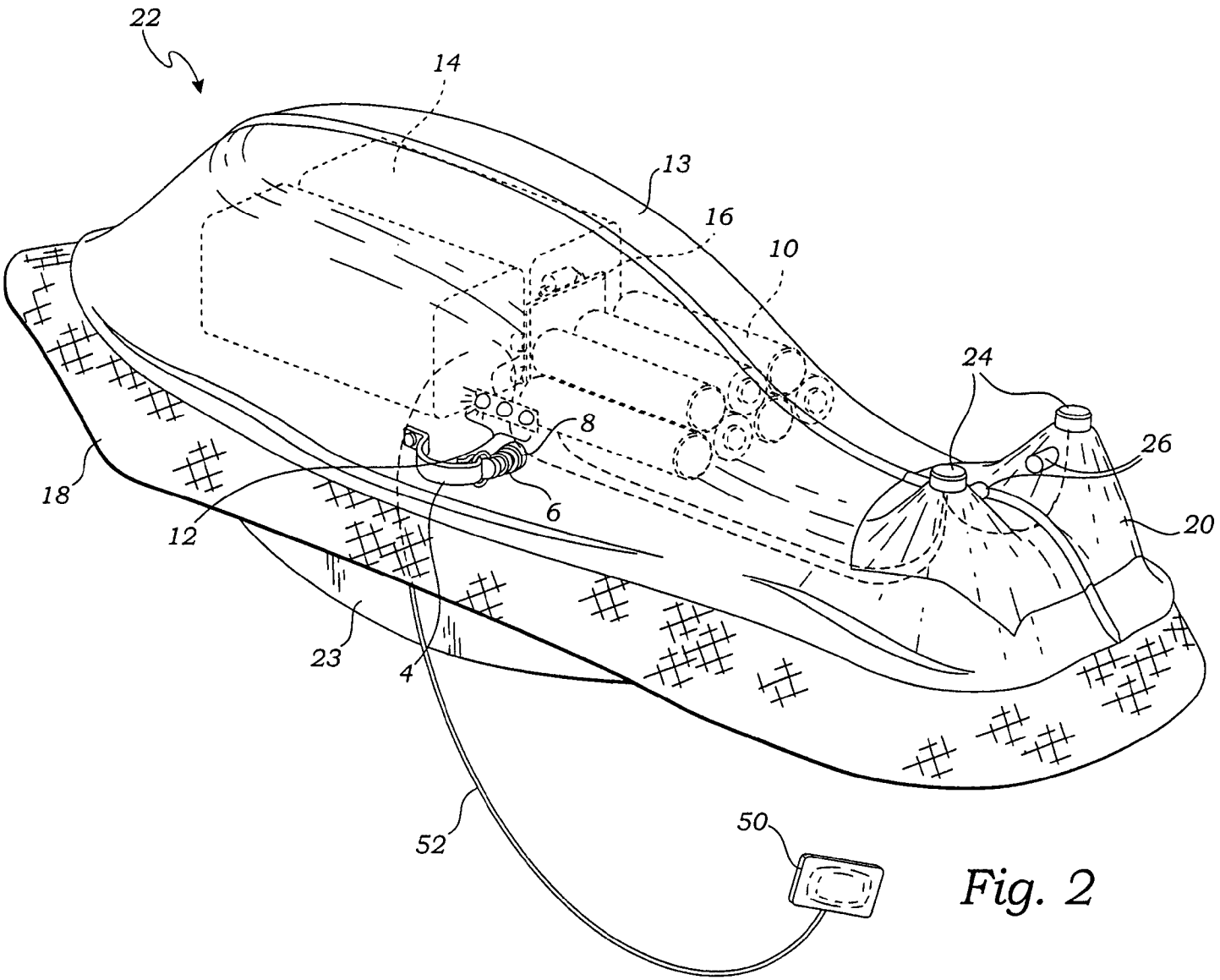
FIG. 2 is a perspective view of portions of an exemplary shield assembly configured to provide a shield and an electrical shock according to another embodiment of the invention.

FIG. 2 is a perspective view of portions of an exemplary shield assembly 22 configured to provide a shield and an electrical shock according to another embodiment of the invention. Unlike the shield assembly 1 shown in FIG. 1, the shield assembly 22 shown in FIG. 2 includes a housing shield 13 having an extended portion 23 configured to cover the side of a user's forearm. Thus, the top and side of the user's forearm are shielded while allowing the user to electrically shock an animal or another person that comes in contact with the arc head 20. The extended portion 23 is shown and discussed in greater detail in relation to FIGS. 9–12 below.

Suitable materials for the housing shield 13 and extended portion 23 include, for example, hard plastics, metals, and metal alloys. In an exemplary embodiment, the housing shield 13 and extended portion 23 comprise a strong and lightweight material such as a carbon fiber composite. In addition, or in other embodiments, the housing shield 13 includes strong, light-weight, flexible materials such as Kevlar®, Dyneema, and/or ballistic nylon to further resist and disperse impact forces. As discussed in detail below, the housing shield 13 may also include a foam and/or gel to absorb and disperse impact forces.

For illustrative purposes, the battery pack 10, the high voltage module 14, and the battery state indicator module 16 discussed above are shown with dashed lines positioned beneath the housing shield 13. Also, the arc head 20 discussed above is shown attached to the housing shield 13.

The shield assembly 22 includes a trigger button 50 configured to actuate a high-voltage stun shock to an attacker when the shield assembly 22 is activated. Electricity is run to the trigger button 50 via wire 52 to fire the stun device. In an embodiment, the wire 52 runs along the length of, and inside the housing shield 13 before exiting at the front of the housing shield 13 to a location on or near the hand of the user. As discussed in more detail below, in one embodiment, the trigger button 50 is sewn into the palm of a user's glove. When the trigger button 50 is pressed, an internal switch is closed so as to provide power from the high voltage module 14 to the terminals 24, 26 of the arc head 20.

Figure 3:
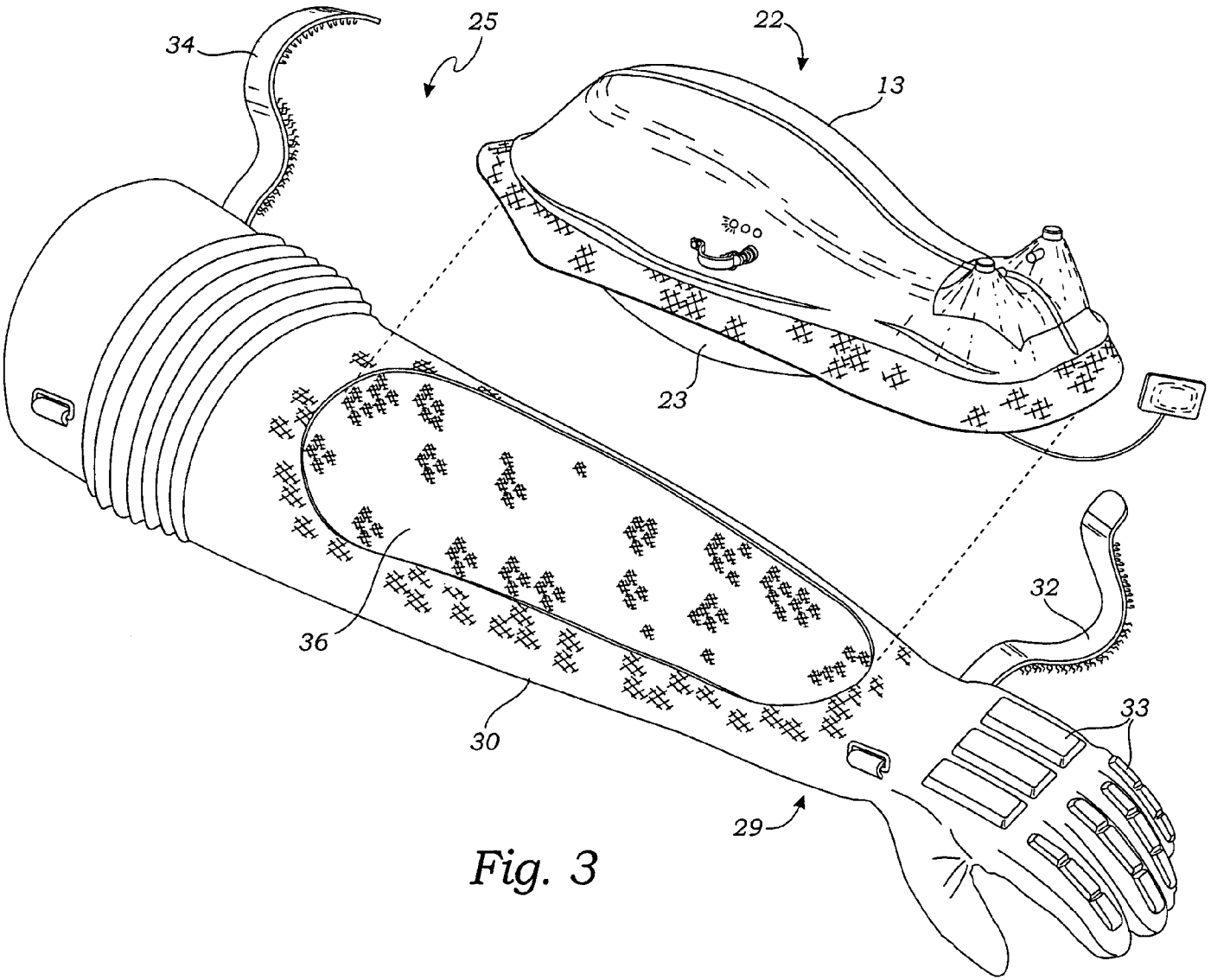
FIG. 3 is a perspective view of a partially disassembled personal defense device including an exemplary gauntlet style glove and the shield assembly of FIG. 2 according to an embodiment of the invention.

FIG. 3 is a perspective view of a partially disassembled personal defense device 25 including an exemplary gauntlet style glove 29 and the shield assembly 22 of FIG. 2 according to an embodiment of the invention. The glove 29 includes an arm gauntlet 30 with an attachment area 36 sized, positioned and configured to be attached to the shield assembly 22. While the attachment area 36 can be comprised of a hard material, such as a metallic or ceramic plate, in an embodiment, the attachment area 36 advantageously comprises a softer, cushioning, impact-dispersive material such as foam. The impact dispersive material of the attachment area 36 reduces the risk of injury to the user or damage to the electronics from blows to the housing shield 13 sustained from an attacker.

In certain embodiments, the personal defense device 25 includes one or more hand protection devices 33 attached to the glove 29 so as to be over the back of the user's hand and/or fingers. The hand protection devices 33 comprise a rigid material such as metal or hard plastic and are configured to protect the user's hand from impact forces. An artisan will recognize from the disclosure herein that other types and styles of gloves can also be used. For example, the glove 29 may comprise a light-weight exercise glove that extends to approximately the user's mid-forearm region. In certain such embodiments, the glove 29 does not include hand protection devices 33 and may be fingerless. In addition, or in other embodiments, the housing shield 13 is smaller, lighter, and has a lower profile than that shown in FIG. 3. Thus, the personal defense device 25 can be used during exercise or other physical activities where less weight and a smaller profile are desired.

Although it is possible to make an embodiment wherein the housing shield 13 is removable from the attachment area 36, in an embodiment, the housing shield 13 is substantially permanently attached to the material. A removable attachment, such as zipper or hook-and-loop material, is likely to be damaged during an attack. This could dislodge the housing shield 13 from the arm gauntlet 30, with potentially adverse consequences to the user of the shield assembly 22.

The glove 29 also includes two attachment straps, a front strap 32 and a rear strap 34. These straps 32, 34 are used to secure the arm gauntlet 30, with attached housing shield and internal components, to the arm of the user. In use, a user slips a hand into the glove 29, positions the forearm correctly and comfortably within the arm gauntlet 30, and tightens the front strap 32 and rear strap 34.

Figure 4:
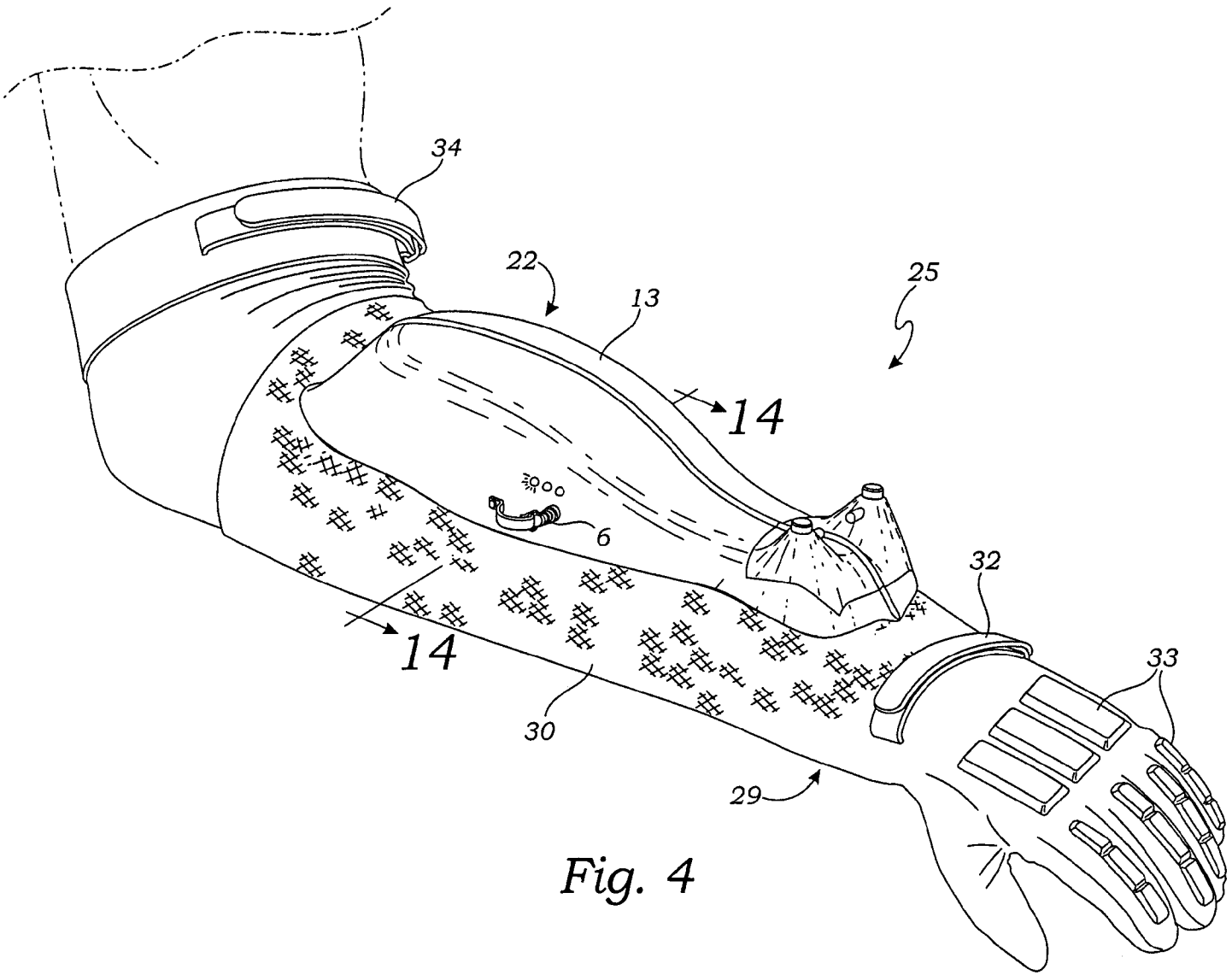
FIG. 4 is a perspective view of the personal defense device of FIG. 3 according to an embodiment of the invention.

FIG. 4 is a perspective view of the personal defense device 25 according to an embodiment of the invention. In FIG. 4, the personal defense device 25 is illustrated with the shield assembly 22 of FIG. 2 attached to the arm gauntlet 30 of the glove 29 shown in FIG. 3. In one embodiment, as illustrated in FIG. 4, the front strap 32 is configured to adjust the fit of the glove 29 around the user's wrist and the rear strap 34 is configured to adjust the fit of the glove 29 above or near the user's elbow. Thus, it would be difficult for an attacker to remove the glove 29 with the shield assembly 22 from the user during an attack. Although not shown, in certain embodiments, the glove 29 extends to approximately the middle of the user's bicep.

The housing shield 13 covers a substantial portion of the user's forearm. In some embodiments, the housing shield 13 covers at least a third of the user's forearm. In other embodiments, the housing shield 13 covers between approximately 50% and approximately 95% of the top of the user's forearm. In other embodiments, the housing shield 13 covers between approximately 20% and approximately 50% of the top of the user's forearm. In other embodiments, the housing shield 13 covers substantially the entire top of the user's forearm and may extend above the elbow and/or below the wrist. In certain embodiments, the housing shield 13 extends over at least a portion of the user's wrist to protect the wrist from impact forces. In addition, or in other embodiments, the housing shield 13 extends over the sides of the user's forearm. In certain such embodiments, the housing shield 13 extends substantially all the way around the user's forearm to protect all sides of the forearm from impact forces.

Figure 5:
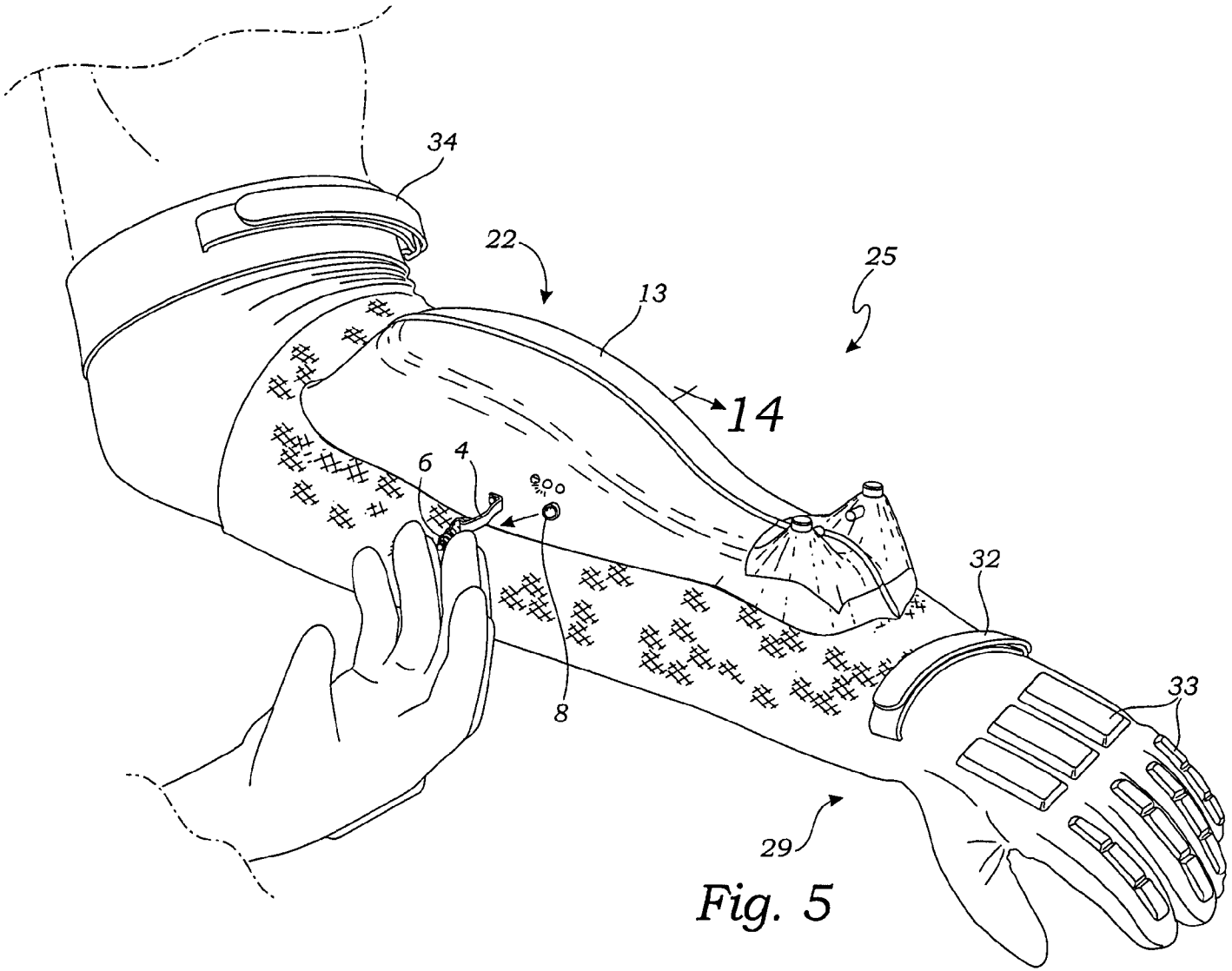
FIG. 5 is a perspective view of the personal defense device of FIG. 3 being activated by a user according to an embodiment of the invention.

As shown in FIG. 4, the shield assembly 22 is attached to the glove 29, charged, and ready for use simply by removing the disarm pin 6. FIG. 5 is a perspective view of the personal defense device 25 of FIG. 4 being activated by a user according to an embodiment of the invention. The operator activates the personal defense device 25 by removing the disarm pin 6 from the activation port 8 of the shield assembly 22. The trigger button 50 (shown in FIG. 2) will now be "live" and ready to use upon user command.

Figure 6:
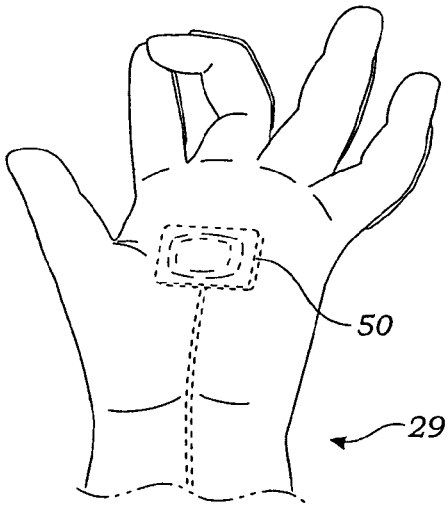
FIG. 6 illustrates a trigger button positioned in the palm of a user's hand for delivering an electrical shock according to an embodiment of the invention.

FIG. 6 illustrates the trigger button 50 positioned in the palm of a user's hand for delivering an electrical shock according to an embodiment of the invention. In one embodiment, the trigger button 50 is sewn into the palm of the glove 29 shown in FIGS. 3–5. In certain such embodiments, the trigger button 50 is concealed below the outer surface of the glove 29 so it is protected and so that its location is not known to an attacker. In other embodiments, the trigger button 50 is attached to the outer surface of the glove 29. In an embodiment, the trigger button 50 is a pressure-sensitive button. When the Trigger button 50 is pressed, for instance, during confrontation with an aggressor, a high-voltage, less-lethal shock is delivered to the terminals 24, 26 of the arc head 20.

Figure 7:
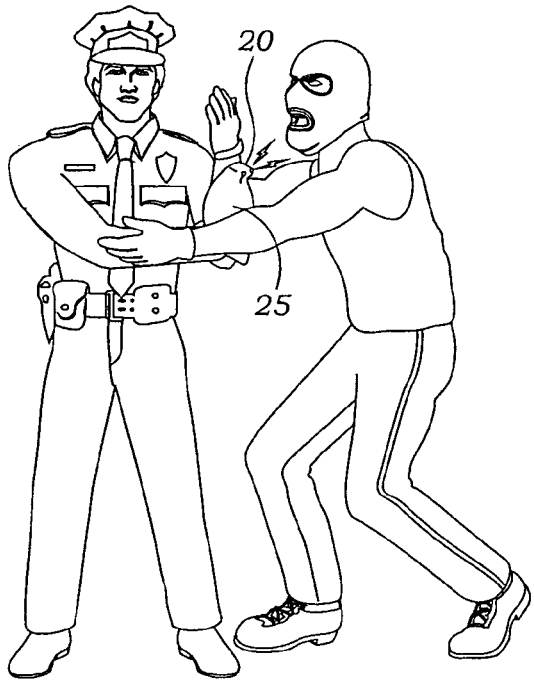
FIG. 7 illustrates an exemplary use of the personal defense device by a police officer in subduing an attacker according to an embodiment of the invention.

FIG. 7 illustrates an exemplary use of the personal defense device 25 by a police officer in subduing an attacker according to an embodiment of the invention. In this example, the police officer is wearing the personal defense device 25 on his left arm. The attacker has grabbed the officer's right arm, intending to prevent the office from reaching his service weapon. The attacker had not anticipated the officer's use of the personal defense device 25, and is seen in the figure in the process of receiving an electrical shock administered from the shock terminals of the arc head 20. This example demonstrates the officer's ability to conduct normal duties, such as pat down or apply handcuffs to a suspect, unobstructed while armed with the personal defense device 25.

Figure 8:
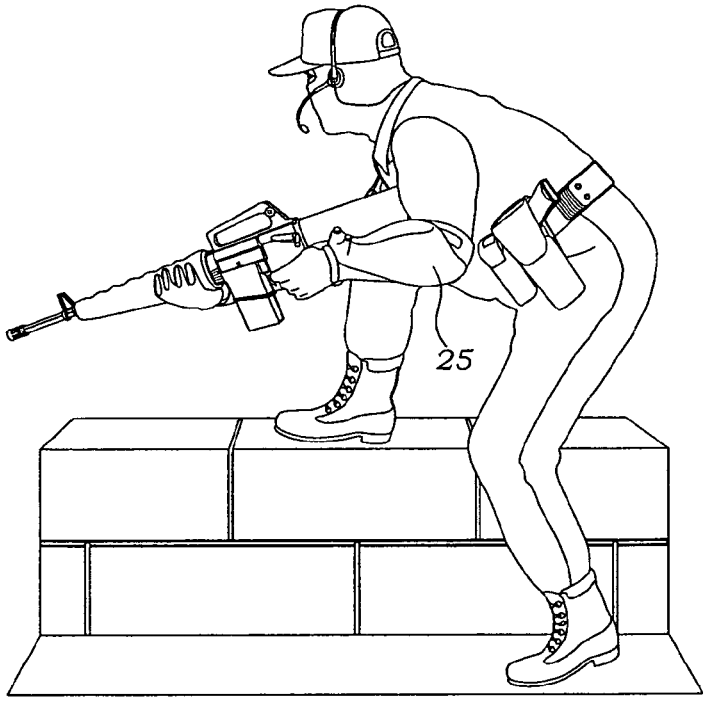
FIG. 8 illustrates a use of the personal defense device by a police officer carrying a firearm.

FIG. 8 illustrates another exemplary use of the personal defense device 25 by a police officer carrying a firearm. In this example, the police officer, possibly a member of a Special Weapons and Tactics (SWAT) team, takes position while armed with an assault rifle for active and long-range attack. The officer is wearing the personal defense device 25 on his left arm for close quarters combat. Thus, the officer is equipped to respond to deadly force threats using his rifle, and to respond to severe but less-lethal close proximity force with the personal defense device 25. The personal defense device 25 offers an important tool for users who are under increasing scrutiny for using deadly force to respond to situations that may not require the use of deadly force. This type of situation, which occurs all too frequently, can be avoided if a suitable attacker control device, such as, the personal defense device 25 is available for the user.

Figure 9:
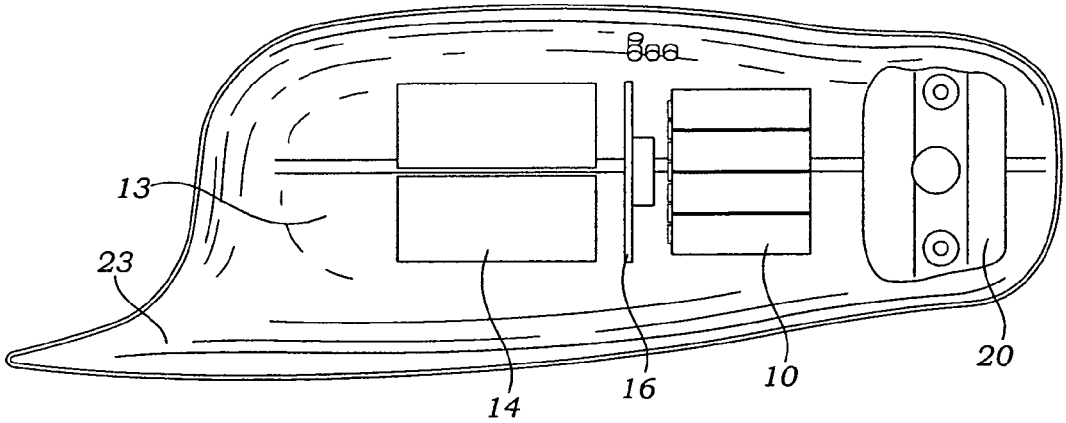
FIG. 9 is a bottom view of the housing shield of FIG. 2.

FIG. 9 is a bottom view of the housing shield 13 of FIG. 2. For illustrative purposes, the apron 18 is not shown in FIGS. 9–12 and the battery pack 10, the battery state indicator module 16, the high voltage module 14 and the arc head 20 are shown on the interior of the housing shield 13 in FIG. 9. The housing shield 13 includes the extended portion 23 configured to shield the front or outside portion of the forearm. As discussed above, in certain embodiments, the arc head 20 (shown from below in FIG. 9) is mounted through an opening in the housing shield 2 from below and is snapped into place such that the arc head 20 cannot be pulled from the housing shield 2 by an attacker from above.

Figure 10:
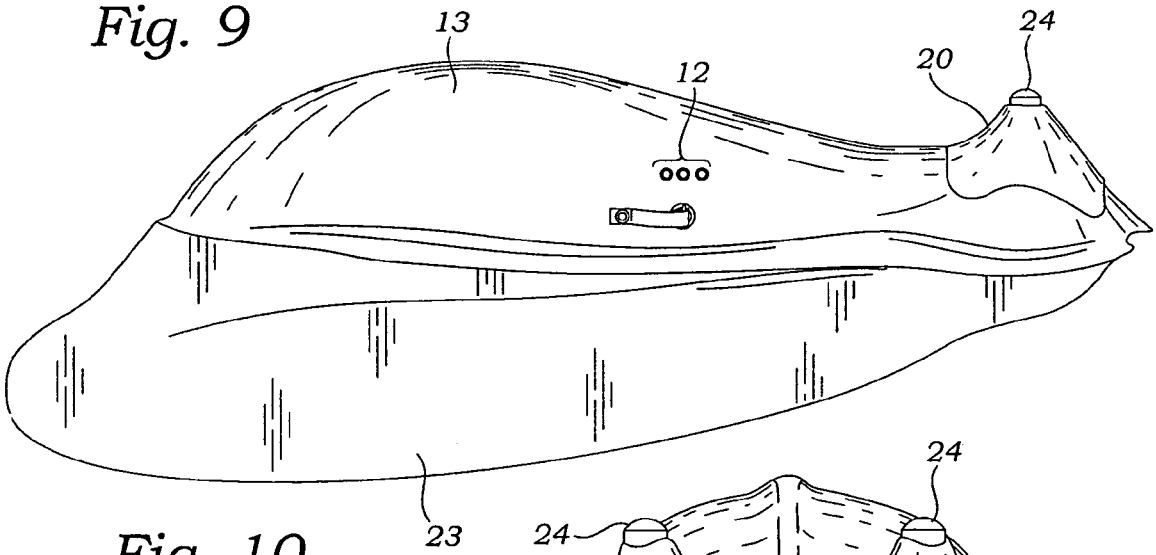
FIG. 10 is a left side view of the housing shield of FIG. 2.

FIG. 10 is a left side view of the housing shield 13 of FIG. 2. Quite visible in this view is the distinctive curve of the upper surface of housing shield 2, and the peak at the electrodes of arc head 20. Also visible in this view is the underside of the extended portion 23 of the housing shield 13.

Figure 11:
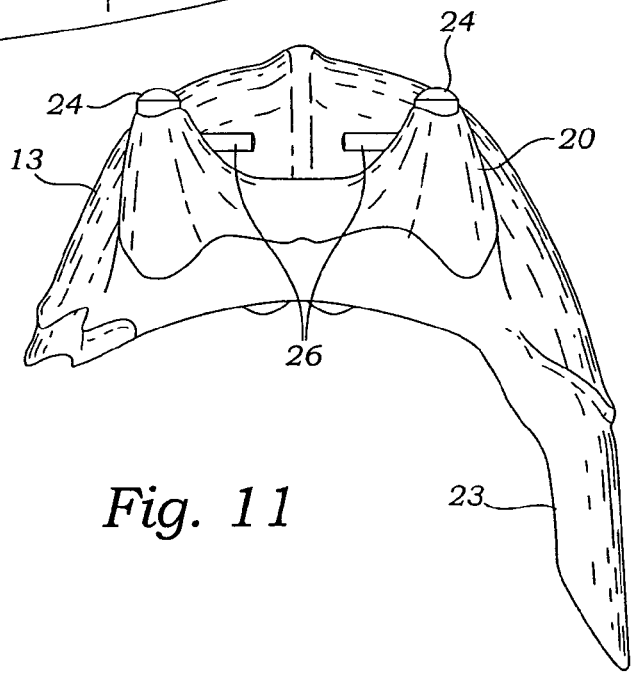
FIG. 11 is a front view of the housing shield of FIG. 2.

FIG. 11 is a front view of the housing shield 13 of FIG. 2. In this view, the extended portion 23 of the housing shield 13 configured to extend over the outside or lead side of the arm is shown. In the exemplary embodiment shown, this is a left handed housing shield 13. Thus, the extended portion 23 or right side (as viewed from the front) of the housing shield 13 extends downward to protect the outward side of the arm, that being a likely side from which an attack may approach. Terminals 24 and 26 are shown on the arc head 20.

FIG. 12 is a front view of a housing shield 13 including a camera 70 according to another embodiment of the invention. The camera 70 may include any type of analog or digital imager including, for example, a charge coupled device (CCD) or complimentary metal oxide semiconductor (CMOS) device. The camera 70 is positioned at the front or leading edge of housing shield 13, pointed to focus on an attacker when a user points his hand at the attacker. In one embodiment, the camera 70 generates still images. In another embodiment, the camera 70 generates moving or video images. In addition, or in other embodiments, the camera 70 includes audio circuitry configured to capture and/or record conversation or other nearby sounds.

In one embodiment, the user can select when to generate images using the camera 70. For example, when an attack begins, the user wearing the housing shield 23 can take pictures or record video by, for example, removing the disarm pin 6 from the activation port 8 and/or momentarily pressing the trigger button 50. In certain embodiments, a separate switch is provided for taking pictures, and/or recording audio and/or video without the need to arm the stun mechanism. In certain embodiments, momentarily pressing the trigger button 50 delivers an electrical shock and holding down the trigger button 50 for approximately one to two seconds activates the camera 70 or performs other functions such as communicating with a central station or monitoring service, as discussed below. Thus, for example, a user can temporarily generate an electrical arc to frighten a would-be attacker such as a dog without generating video or calling in to a central station or monitoring service.

In certain embodiments, still and/or video images are stored in the shield assembly 22. In other embodiments, the shield assembly 22 includes a communication device (not shown) configured to transmit image data and/or audio data to a remote location for storage or further processing. By transmitting the image data to a remote location, reliable evidence can be securely recorded such that it cannot be tampered with by the user or an attacker. Information transmitted to the remote location can be used to identify the user and the attacker and gather other evidence during a confrontation between them.

In one embodiment, the communication device comprises a two-way radio configured to communicate with, for example, a police or military command post. In another embodiment, the communication device comprises a cellular or satellite telephone configured to transmit image data to a central station, for example, to which the user subscribes for security monitoring of the user's use of the shield assembly 22. The central station may be located locally or in another city, state, or country. In one embodiment, the central station offers security monitoring services similar to burglar alarm system monitoring services for residential or business properties. In addition, or in other embodiments, the communication device comprises a laser communication module configured to provide one or two-way communication for secure operations with little or no detection by unauthorized third parties. For example, U.S. Pat. No. 5,801,866, titled "Laser Communication Device," issued Sep. 1, 1998 to Chan et al., which is hereby incorporated herein in its entirety, discloses a portable laser communication transceiver usable by the personal defense device 25.

For example, according to one embodiment, the communication device is configured to transmit the image data to the central station for monitoring the use of the shield assembly 22 and for providing appropriate assistance to a registered user of the shield assembly 22. For example, monitoring personnel at the central station may use the information received from the shield assembly 22 to determine whether police, medical, or other emergency assistance is needed at the location of the registered user. In certain embodiments, the communication device also provides one or two-way audio communication between the user and the central station to better evaluate the scene where the user is located, to determine the location of the user, and to provide direct assistance to the user. In one embodiment, the shield assembly 22 comprises a system for communicating with a receiver/processor center as disclosed by U.S. Pat. No.

6,876,302, titled "Non-Lethal Personal Deterrent Device," issued Apr. 5, 2005 to Steeves, which is hereby incorporated herein in its entirety.

In one embodiment, a projectile system is incorporated into the housing shield 13. The projectile system may be a mechanical, electrical, or compressed gas projectile system for projecting objects. For example, the projectile system may project pellets, metal balls, bullets, stunning electrodes, pepper spray, or any other defensive projectile. FIG. 12A shows one embodiment of a projectile system. As shown in FIG. 12A, shield assembly 22 incorporates a pellet projectile system. Housing shield 13 has nozzle 71 for projecting pellets 72. In one embodiment, housing shield 13 has a $CO_2$ cartridge, which, when activated releases a small spurt of $CO_2$ gas with enough force to project a pellet out of the shield assembly 22 and toward an intended target. Extra pellets 72 may be stored within the shield assembly 22 or outside of the shield assembly 22. As one pellet is projected out of the shield, another pellet is loaded into the projectile system so that another pellet may be projected if needed. In one embodiment, a slingshot system is used by the shield assembly 22 to project a projectile such as a pellet.

In one embodiment, a solution, such as, for example, pepper spray, such as, for example, oleoresin capsicum, or tear gas is projected out of the personal defense device. FIG. 12B illustrates an example of a police officer spraying a solution 133 onto an attacker. A small canister of a solution is stored within the shield assembly 22 and aligned on the same axis as the nozzle 131. When a user, such as a police officer, activates the solution sprayer, such as by pushing button 135, a solution 133 is sprayed out of nozzle 131 at a would be attacker.

In one embodiment, the projectile system projects electrodes, either attached to electrode wires, or unattached, which subdue an attacker by shocking them. FIG. 12C illustrates an example of a police officer using the personal defense device to project electrodes at an attacker. Shield assembly 22 includes a nozzle 151 for projecting electrodes 155 at an attacker. The user activates the electrodes by pushing a button or pulling an activation switch. The electrodes are then projected out of the shield assembly 22 at an attacker.

The projectile system can be activated through the use of a button either on the shield or through a button on the palm of the hand. In addition, the projectile system can be activated through the use of a switch, a pull tab, a trigger mechanism, or any other appropriate activation mechanisms. In addition, any known projectile systems may be used with the present disclosure, including for example, projectile systems incorporated in guns, pepper spray cans, shocking devices.

FIG. 13 is a perspective view of the underside of the arm gauntlet 30 of the personal defense device 25 of FIG. 4 including a global positioning unit 80 according to an embodiment of the invention. FIG. 13 also illustrates the extended portion 23 of the housing shield covering at least a portion of the side of the user's forearm. In one embodiment, as shown in FIG. 13, the global positioning unit 80 is attached to the underside of the arm gauntlet 30. In certain embodiments, the global positioning unit 80 is positioned at least partially under the housing shield so as to be protected from an attacker. The global positioning unit 80 is configured to determine the user's location by receiving signals from global positioning system (GPS) satellites.

In one embodiment, the user can use the location information to navigate from place to place. In addition, or in other embodiments, the communication device discussed above is configured to transit the user's location to the command post or central station so emergency assistance can be automatically directed to the user. In certain such embodiments, the communication device is in regular contact with the command post or central station to provide real-time information of the positions of operatives or subscribers wearing the personal defense device 25. Further, when the camera 70 is active, the command post or central station will know of an attack, and can send reinforcements or emergency assistance without the need for a verbal request. This is advantageous to a lone operative, for example, who may not have time to make a verbal request for backup or verbally provide location information.

In addition, or in other embodiments, the global position unit 80 and/or communication device includes a display 82 and input keys 84. In certain such embodiments, the personal defense device 25 is configured to provide internet access and/or other wired or wireless communication including, for example, cellular phone communication or Bluetooth communication. In certain embodiments, two or more personal defense devices 25 can communicate with each other through wired or wireless communication. In one embodiment, the personal defense devices 25 have identification information stored on the devices so that the personal defense device can be identified quickly, by, for example, a police officer or at a security check point. Thus, the personal defense device can be easily identified by authorized personnel. In one embodiment, the personal defense device can be identified, and information stored thereon obtained, by authorized personnel without the user being aware of the communication taking place. In certain embodiments, the display 82 comprises a liquid crystal display (LCD) or other types of displays generally used by, for example, cellular phones or personal digital assistants (PDAs).

An artisan will recognize from the disclosure herein that the personal defense device 25 may include a wide variety of devices and/or weapons. For example, the personal defense device 25 may be configured to transmit an electrical charge to an attacker without making physical contact with the attacker. For example, the SunStrike™ device available from Extreme Alternative Defense Systems, LTD. of Anderson, Ind. may be configured for use with the personal defense device 25 to deliver a lightning-like discharge to an attacker. As another example, the personal defense device 25 may be configured to dispense a loud siren noise (such as from an air siren canister) that disorients, frightens and/or renders an attacker helpless. FIG. 13B illustrates an example of a siren nose 143 used to stop an attacker. A police officer, or other user, activates a switch, such as switch 145, which releases a loud noise 143 out of the an opening 141 of the shield assembly 22.

The personal defense device 25 may also include non-weapon devices such as solar panels to recharge the battery pack 10 and/or operate electronic circuitry. FIG. 13A illustrates an embodiment of the personal defense device incorporating solar panels. In some embodiments, solar panels 122 are located on the personal defense device 25. The solar panels can be located on the glove 29 or on the shield assembly 22. In some embodiments, the solar panels are located on a storage enclosure 123, such as, for example, a carrying case or backpack, configured to stow the personal defense device 25 when not in use. Personal defense device storage enclosure 123 has solar panels 126 for charging a battery 125. In one embodiment, the solar panels 126 provide a trickle charger. In one embodiment, the battery 125 also has a cord for plugging into a standard electrical outlet to charge the battery 125. The battery 125 is connectable to the battery 10 through the shield assembly 22 in order to charge the battery pack 10. In one embodiment, the solar panels directly charge the battery pack 10. For example, U.S. Pat. No. 6,870,089, titled "System and Apparatus for Charging an Electronic Device Using Solar Energy," issued Mar. 22, 2005 to Gray, which is hereby incorporated by reference herein in its entirety, discloses a portable apparatus that can be used to charge the battery pack 10 while carrying or attached to the personal defense device 25.

Figure 13C:
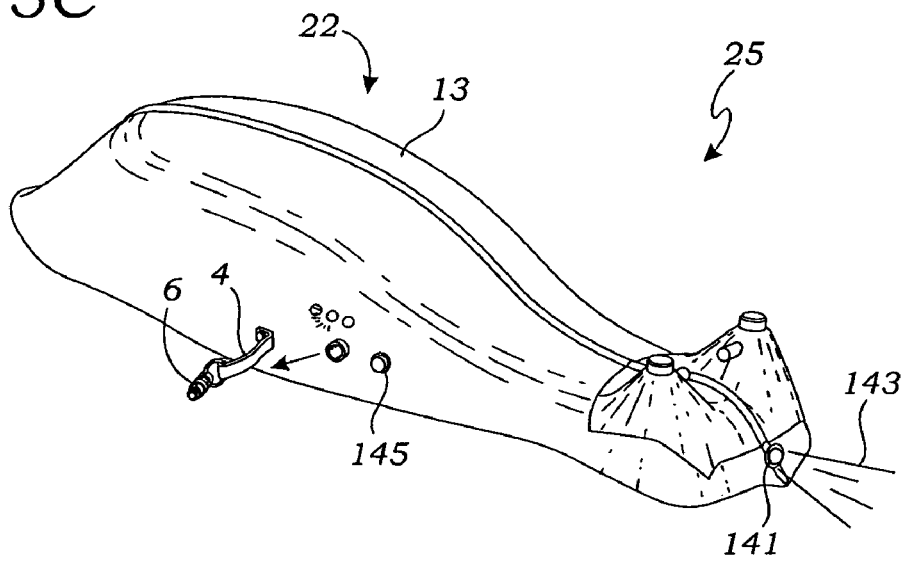
FIG. 13C illustrates is a perspective view of a shield assembly including a light source.
Figure 13D:
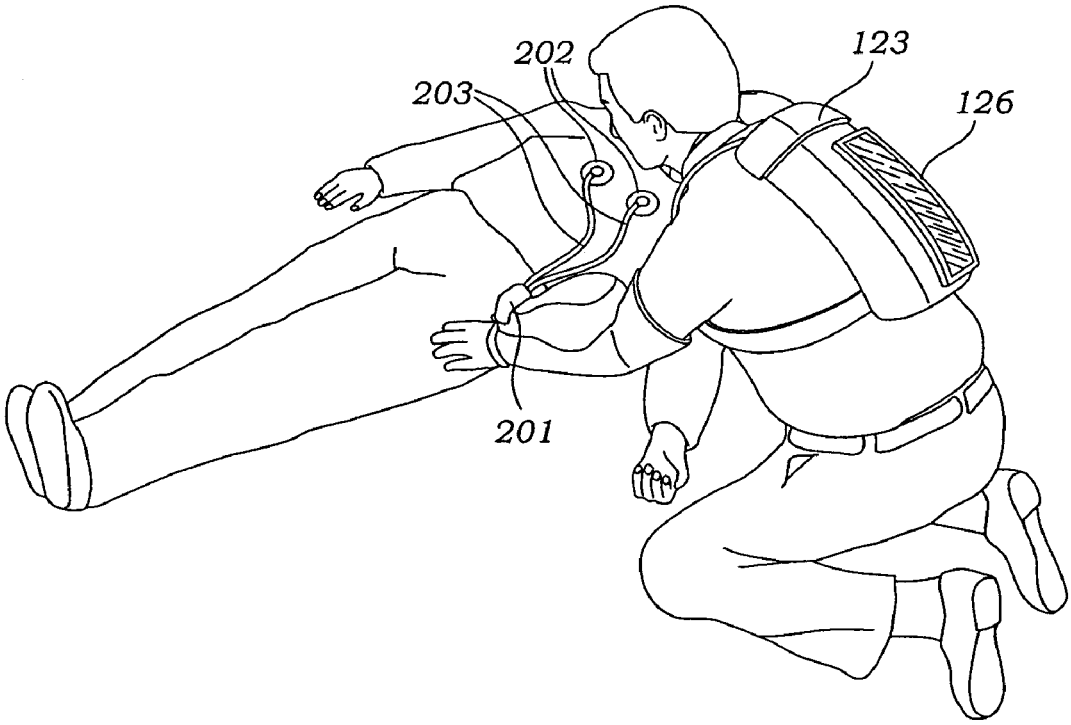
FIG. 13D illustrates using the personal defense device to defibrillate another person.

As another example, the personal defense device 25 may include a defibrillation mode to treat ventricular fibrillation wherein an electric shock can be delivered to a patient to terminate a cardiac arrhythmia in which the patient's heart is unable to pump a significant volume of blood. FIG. 13D illustrates an embodiment of the personal defense device 25 which includes defibrillation electrodes 202 or paddles configured to attach to the arc head 20 through attachment member 201 configured to snap over or otherwise quickly attach to the arc head 20. Arc head 20 releases a charge which is received by attachment member 201 and sent through lines 203 to electrodes 202 which shocks a patient to end a cardiac arrhythmia. In some embodiments, the personal defense device 25 includes defibrillation circuitry and/or ECG detection circuitry as disclosed in U.S. Pat. No. 5,658,316, titled "Portable Defibrillator with Disposable Power Pack," issued Aug. 19, 1997 to Lamond et al., which is hereby incorporated by reference herein in its entirety.

Other examples of non-weapon devices useable by the personal defense device 25 include a glass breaking device, a flashlight (including, for example, a high-intensity discharge lamp, an incandescent light bulb, a light emitting diode, or other light source), or a spring-loaded tool shaft. The spring loaded tool shaft may be configured, for example, to eject a tool or weapon such as a knife from the personal defense device 25. FIG. 13C illustrates an embodiment of the personal defense device including a light source 141. The shield assembly 22 includes a light source 141, such as a flashlight, for projecting light 143. The shield assembly 22 also includes a light source activation button 145 for activating the flashlight.

As another example, the personal defense device 25 according to one embodiment includes a portable metal detector or frisking device such as the portable metal detector disclosed in U.S. Pat. No. 6,211,672, titled "Human Appendage Mounted Metal Detector," issued Apr. 3, 2001 to Bauman et al., which is hereby incorporated by reference herein in its entirety.

Figure 14:
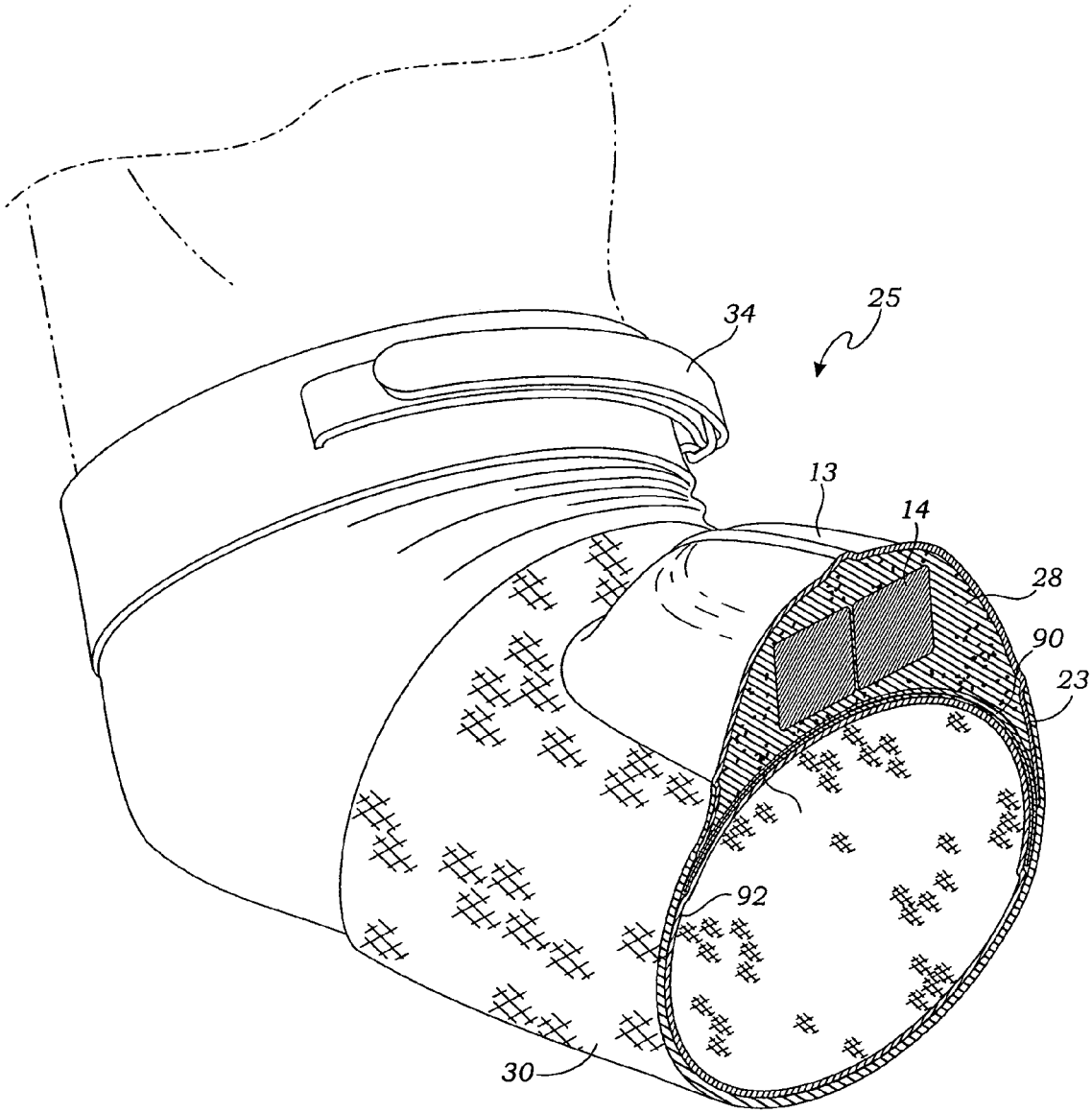
FIG. 14 is a perspective view illustrating a cutaway section of the personal defense device of FIG. 4 according to an embodiment of the invention.

FIG. 14 is a perspective view illustrating a cutaway section of the personal defense device 25 of FIG. 4. As shown in FIG. 14, in certain embodiments, a foam or gel 28 is disposed inside the housing shield 13 along with electronic components (a cross-section of the high voltage module 14 is shown) to stabilize the electronic components underneath the housing shield 13. The gel 28 is configured to absorb and distribute impact forces applied to the housing shield 13 to protect the electronic components and the user's arm. In addition, or in other embodiments, a foam pad 90 beneath the housing shield 13 further absorbs and distributes impact forces to protect the user's arm. In certain embodiments, the arm gauntlet 30 includes a fabric liner 92 configured to separate the user's arm from the housing shield 13 and the outer surface of the arm gauntlet 30. In certain embodiments, the fabric liner 92 comprises a smooth and comfortable material such as lycra. Other suitable materials include, for example, cotton, wool and/or silk.

Figure 15:
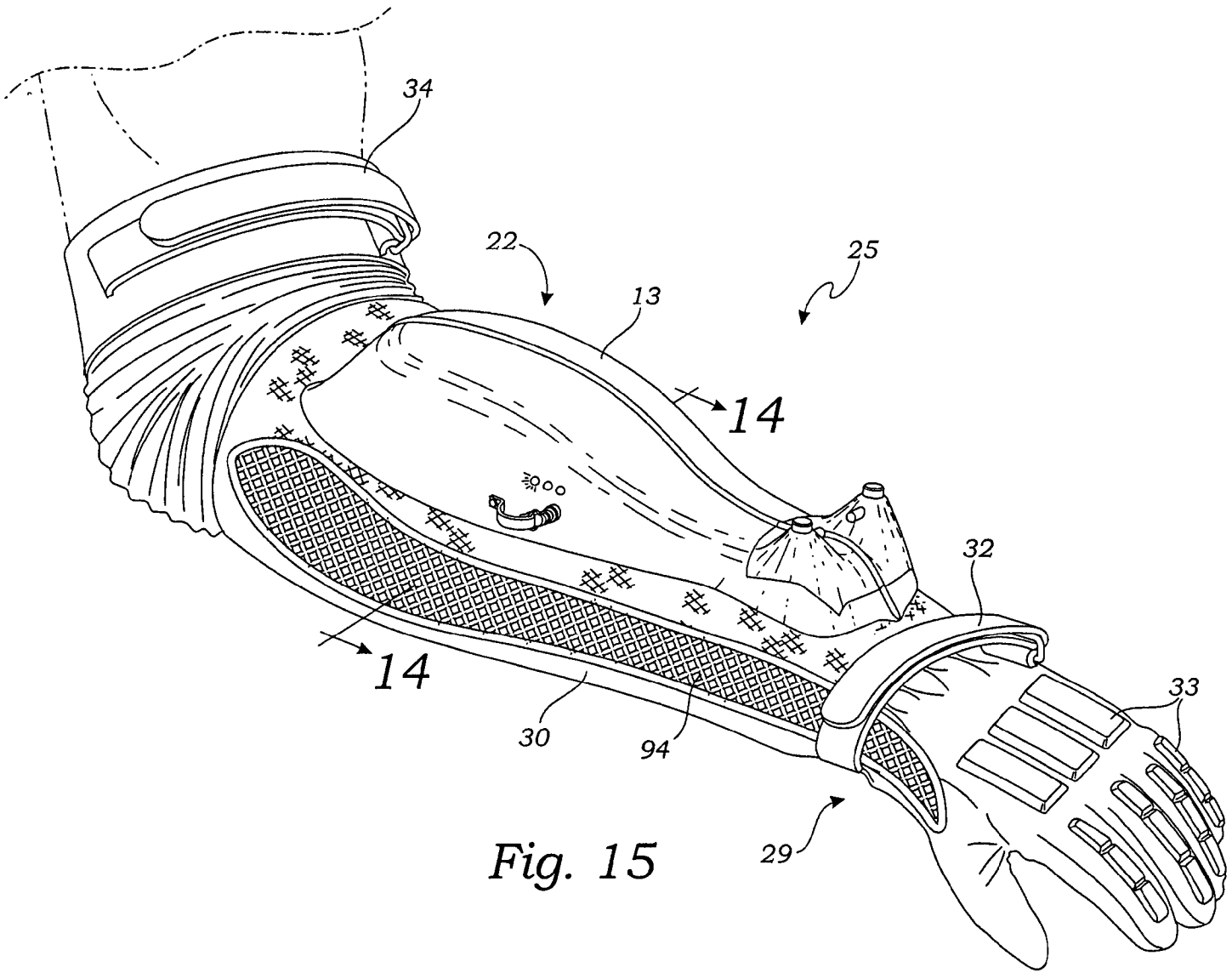
FIG. 15 is a perspective view of the personal defense device of FIG. 4 including a breathable panel in the arm gauntlet area of the glove according to an embodiment of the invention.

FIG. 15 is a perspective view of the personal defense device 25 of FIG. 4 including a breathable panel 94 in the arm gauntlet area 30 of the glove 29 according to an embodiment of the invention. The breathable panel 94 is configured to provide air flow to a user's arm during use and to allow perspiration to evaporate, thus cooling the user's arm and providing increased comfort. In certain embodiments, the breathable panel 94 comprises a mesh or other ventilation material 94.

Figure 16:
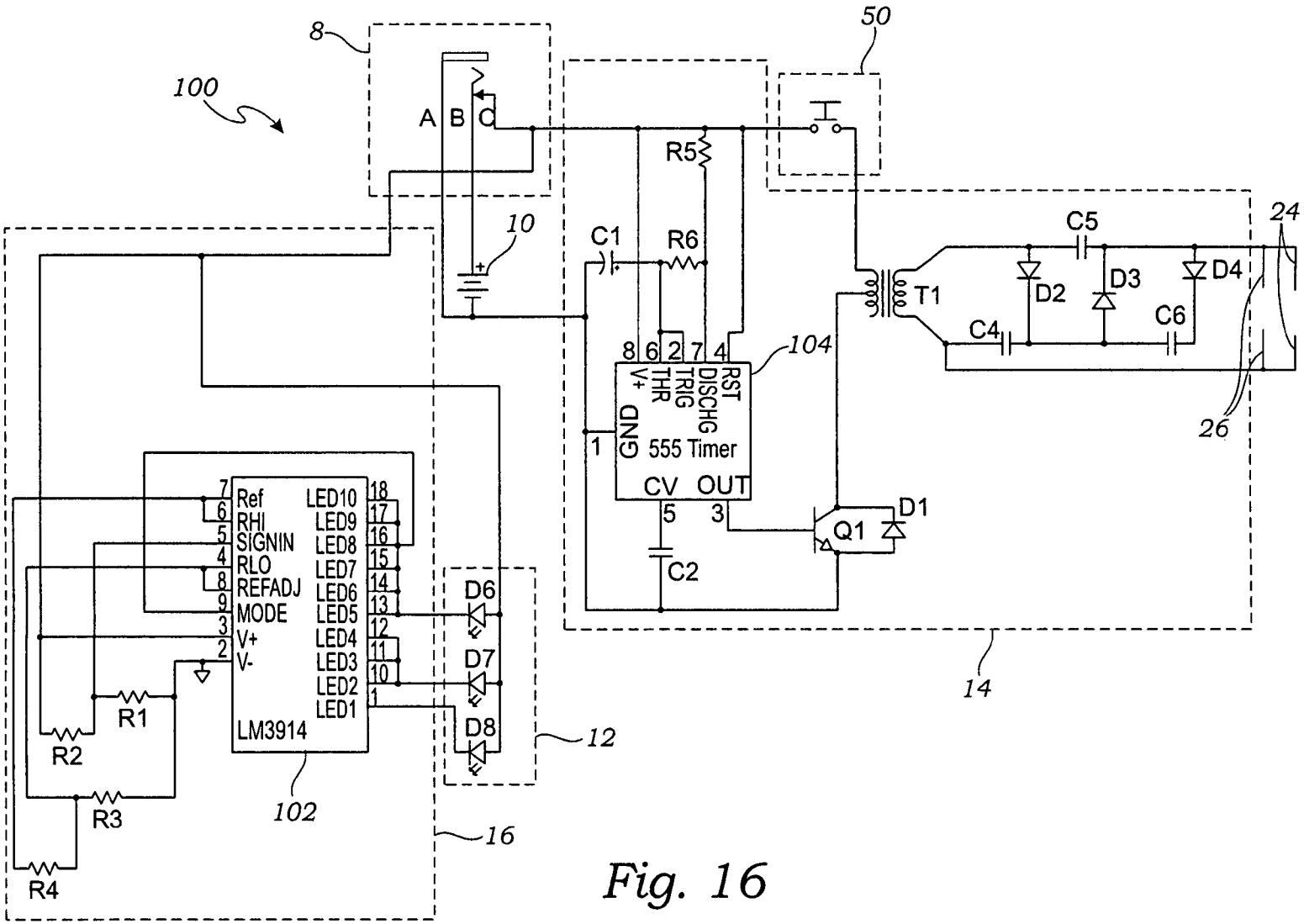
FIG. 16 is a block diagram of electrical circuitry usable by the shield assembly of FIG. 2 according to an embodiment of the invention.

FIG. 16 is a block diagram of one embodiment of electrical circuitry 100 usable by the shield assembly 22 of FIG. 2 according to an embodiment of the invention. It is to be understood that any circuitry for delivering a high voltage shock will work with the disclosure of the present invention, and the diagram of FIG. 16 is shown as an example of one circuit and is not shown by way of limitation. The electrical circuitry 100 includes the activation port 8, battery pack 10, LEDs 12, high voltage module 14, battery state indicator module 16, terminals 24, 26 and trigger button 50 discussed above. The activation port 8 includes pins A, B and C used to control connections between the battery pack 10, the trigger button 50 and the battery state indicator module 16 when the disarm pin 6 (see, for example, FIG. 5) or external power charger (not shown) is inserted in the activation port 8.

To charge the battery pack 10, a connector from the external power charger is inserted into the activation port 8 so as to create an electrical path between pin A and pin B. With the external power charger inserted in the activation port 8, pin C is disconnected from pins A and B. The connection between pin A and pin B allows current to flow from the external power charger to the battery pack 10 during a charging cycle. When the disarm pin 6 is inserted into the activation port 8, none of the pins A–C are connected to one another. Thus, with the disarm pin 6 inserted, power is not provided from the battery pack 10 to the high voltage module 14 or the battery state indicator module. In this disarmed state, the LEDs are not lit and the user cannot provide a voltage to the terminals 24, 26 by pressing the trigger button 50.

When neither the disarm pin 6 nor the external power charger are inserted in the activation port 8, pin A is not connected and pin B is connected to pin C. This is the active or live shocking state and the battery pack 10 is electrically connected to the high voltage module 14 and the battery state indicator module 16. As discussed above, in this state the battery state indicator module 16 is configured to measure the relative charge remaining in the battery pack 10 and the high voltage module 14 is configured to convert a relatively low voltage from the battery pack 10 to a relatively high voltage. The relatively high voltage can then be provided to the terminals 24, 26 when the user presses the trigger button 50.

As discussed above, in an exemplary embodiment, the three LEDs 12 are red, yellow and green. The green light is lit when the battery pack 10 is amply charged, the yellow light is lit when the battery pack 10 needs charging and the red light is lit when the battery pack 10 is critically discharged. If none of the LEDs 12 are lit during the activated state, the battery pack 10 is discharged such that it can provide little or no power and should be recharged or replaced.

While certain embodiments of the inventions have been described, these embodiments have been presented by way of example only, and are not intended to limit the scope of the inventions. For example, other non-lethal methods of incapacitating a threat may also be incorporated to the devices of the present disclosure, such as, for example an audio system that incapacitates a would-be attacker. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A personal defense device comprising:

A shield member configured to be worn over at least a third of a length of a user's forearm, said forearm being bounded by the user's ipsilateral wrist and ipsilateral elbow, said length being measured from said wrist to said elbow;

Said shield member conforming closely to the outer surface counters of a forearm;

A portable source of electricity;

and

A plurality of electrical terminals extending outwardly from said shield member; said terminals configured to receive an electrical current from said electrical source, Wherein a first pair of said plurality of electrical terminals is configured to deliver an electrical shock to a human or other animal.

2. The personal defense device of claim 1, wherein said shield member is configured to house said source of electricity and associated electrical circuitry located within said shield member.

3. The personal defense device of claim 2, wherein said electrical circuitry is configured to convert a first voltage level to a second voltage level and to provide said second level to at least said first pair of terminals.

4. The personal defense device of claim 3, wherein said second voltage level is higher than said first voltage level.

5. The personal defense device of claim 3, wherein said second voltage level is configured to disable, at least temporarily, said human or other animal.

6. The personal defense device of claim 1, wherein said shield member is configured to shield said forearm from an attacker.

7. The personal defense device of claim 1, wherein said shield member comprises at least one of carbon fiber, Kevlar®, Dyneema, ballistic nylon, foam and gel.

8. The personal defense device of claim 7, wherein said shield member is configured to absorb and disperse an impact from an attacker.

9. The personal defense device of claim 1, further comprising a pair of terminals configured to generate a spark, wherein said spark generates an electric current arcing noise.

10. The personal defense device of claim 9, wherein said arcing noise is in an audible range between about 65 decibels and about 75 decibels at a distance of about 1 meter.

11. The personal defense device of claim 1, further comprising a glove, wherein a gauntlet portion of said glove comprises said shield member.

12. The personal defense device of claim 11, wherein said gauntlet portion is configured to extend above said user's elbow.

13. The personal defense device of claim 11, wherein said glove comprises one or more attachment devices configured to resist removal of said glove from said user by an attacker.

14. The personal defense device of claim 11, further comprising a trigger attached to said glove, said trigger being user selectable to deliver a voltage to said plurality of electrical terminals.

15. The personal defense device of claim 14, wherein said trigger is attached below an outer surface of the palm of said glove.

16. The personal defense device of claim 1, further comprising an active port configured to prevent said delivery of said electrical shock when a disarm pin is inserted therein, and to allow said selective delivery of said electrical shock when said disarm pin is removed from said activation port.

17. The personal defense device of claim 1, further comprising indicia of available power for said electrical shock.

18. The personal defense device of claim 1, wherein said plurality of electrodes are located on a saddle-shaped head to said shield member.

19. The personal defense device of claim 1, further comprising an imaging device said personal defense device configured to transmit image data from said imaging device to a receiving station, said receiving station configured to receive and display said image data.

20. The personal defense device of claim 1, further comprising a global positioning device, said personal defense device configured to transmit position data to a receiving station, said receiving station configured to receive and display said positioning data.

21. The personal defense device of claim 1, further comprising a device for projecting an object.

22. The personal defense device of claim 1, further comprising a second member connectable to said electrical terminals, said second member thereby being rendered capable of defibrillating.

23. The personal defense device of claim 1, further comprising a light source connected to said shield member.

24. The personal defense device of claim 1, further comprising an enclosure for housing one or more batteries and at least one solar panel coupled to said enclosure, wherein the at least one solar panel is configured to charge said batteries, and wherein said batteries are connectable to said electrical terminals and configured to charge said electrical terminals.

25. The personal defense device of claim 1, further comprising a siren connected to said shield member.

26. The personal defense device of claim 1, further comprising a solution, wherein said solution is configured to be projectable from said shield member.

27. A method of subduing an attacker comprising: wearing a device according to claim 1, contacting said attacker with said personal defense device, and activating said electrical terminals, thereby causing an electrical shock to be deployed at said attacker.

28. The method of claim 25, further comprising generating an electrical arcing noise from said shield member, said electrical arcing noise designed to frighten said attacker.

29. The method of claim 25, further comprising transmitting data from said shield member to a receiving station.

30. The method of claim 25, wherein said data comprises one or more of image data, audio data, and location data.

31. The method of claim 25, further comprising deflecting a blow from said attacker with said shield member.

32. A personal defense device capable of delivering an electrical shock to a human or other living creature, said device configured to be worn on the hand and arm of a person, which device comprises:

(a) a glove, fitting around the fingers, hand, and lower arm;

(b) a portable shield, worn on the forearm, and conformably fitted thereto;

(c) wiring for a plurality of electrodes for the discharge of a high-voltage electric shock, (d) at least one activation switch, which when activated creates an electrical signal causing said high voltage electric discharge from said electrodes, (e) an external electrical connector where the wiring from said electrodes and at least one of said activation switches attach;

(f) an internal battery pack to provide electrical power to an electrical circuit and components designed to generate a high-voltage electrical shock;

(g) a multi-conductor wiring harness comprising a plurality of wires with a first end and a second end, said wires comprising electrical connectors on both first and second ends of said wiring harness to allow electrical connection between the hand end of the glove, said battery pack, and between the electrodes and said battery pack;

(h) a high voltage module for converting low voltage current from the battery pack to high voltage for activating the electrodes;

(i) wherein said high voltage module produces the high-voltage electrical current needed to deliver the electrical shock, and the wiring harness carries an electrical activation signal from at least one activation switch;

(j) a central housing for said high voltage module, said housing located underneath said portable shield; and, (k) a master arming connector to turn the power supply from the battery pack on and off.

* * * * *